US005128646A

United States Patent [19]

Suzuki et al.

[11] Patent Number: 5,128,646

[45] Date of Patent: Jul. 7, 1992

[54] IGNITION COIL FOR AN INTERNAL COMBUSTION ENGINE

[75] Inventors: Toshiro Suzuki, Aichi; Koji Yoshikawa, Tsushima, both of Japan

[73] Assignee: Aisan Kogyo Kabushiki Kaisha, Aichi, Japan

[21] Appl. No.: 599,717

[22] Filed: Oct. 19, 1990

[30] Foreign Application Priority Data

Oct. 20, 1989 [JP] Japan ..... 1-274550
Aug. 22, 1990 [JP] Japan ..... 2-221634

[51] Int. Cl.[5] ..... H01F 17/06; H01F 27/24

[52] U.S. Cl. ..... 336/110; 336/178; 336/212

[58] Field of Search ..... 123/634; 336/178, 110, 336/165, 212, 233, 234

[56] References Cited

U.S. PATENT DOCUMENTS 3,209,295 9/1865 Baermann ..... 336/110
3,426,305 2/1969 Keble ..... 336/178
3,968,465 7/1976 Fukui et al. ..... 336/110
4,763,094 8/1988 Kojima ..... 336/178
4,843,362 6/1989 Heritier-Best ..... 336/178
4,990,881 2/1991 Ooyabu ..... 336/178

FOREIGN PATENT DOCUMENTS 2464543 6/1981 France ..... 336/110

*Primary Examiner*—Thomas J. Kozma
*Attorney, Agent, or Firm*—Oliff & Berridge

[57] ABSTRACT

The invention is directed to an ignition coil for use in an internal combustion engine. The ignition coil includes a center core which has a plurality of core members aligned. At least one permanent magnet is disposed between the core members. A primary winding and a secondary winding are mounting on the center core and permanent magnet. The permanent magnet is enclosed in the primary winding at least. An outer core having at least one core member is disposed around the primary winding and secondary winding. One end of the outer core is connected to one end of the center core, wheras the other end of the outer core is connected to the other end of the center core.

7 Claims, 9 Drawing Sheets

IGNITION COIL FOR AN INTERNAL COMBUSTION ENGINE

BACKGROUND OF THE INVENTION

1. Field of the Invention

The present invention relates to an ignition coil for an internal combustion engine, and more particularly to an ignition coil having a permanent magnet disposed in a magnetic circuit.

2. Description of the Related Art

In an ignition system for an internal combustion engine, when a primary current in an ignition coil is intermittently interrupted, a high voltage is obtained from a secondary winding in proportion to the rate of variation of the magnetic flux produced in a core and delivered to an ignition plug to ignite a mixture within a cylinder of the engine.

According to a recent internal combustion engine with its power output increased, the ignition coil requires that its output voltage and discharge energy are increased. Therefore, it is necessary that the cross sectional area of the core is increased, and/or the number of turns of the secondary winding mounted on the core is increased. By so doing, however, the size of the ignition coil will be made larger against a demand for the ignition system of its size reduced as a whole.

As well known and described in Japanese Utility Model Laid-open Publication No. 48-49425, the number of turns of the secondary winding should be increased or the magnetic flux passing through the core should be increased in order to increase the output voltage of the secondary winding. In this Publication, there has been proposed an ignition coil, which includes a magnet disposed in a magnetic circuit for providing a magnetizing force in the direction opposite to the magnetization of the coil in case of closing of a switch for feeding an electric current to the coil. Also, Japanese Patent Publication No. 41-2082 discloses an ignition coil which has a permanent magnet disposed in a magnetic circuit of an iron core, i.e., a core to provide the magnetic flux differential to, i.e., opposite to the magnetic flux created in a primary winding. Japanese Patent Laid-open Publication Nos. 59-167006 and 60-218810 disclose an ignition coil, having a permanent magnet which is disposed in a gap provided in a core. In any of those described above, the core is provided with a gap at a position other than the position on which the primary and secondary windings are mounted, and the permanent magnet is disposed in the gap.

In the ignition coil having the permanent magnet disposed in the magnetic circuit as mentioned above, the magnetic flux variation produced in response to the intermittent interruption of the primary current is increased, so that the output voltage obtained from the secondary winding is increased in comparison with the conventional ignition coils. However, in such ignition coil, since a great leakage of magnetic flux is created when the electric current is fed to the primary winding, most of the increased magnetic flux is offset by the leaked magnetic flux, so that the increasing rate of the magnetic flux is low. While the above-described Publication No. 48-49425 discloses an ignition coil provided with two permanent magnets, which are disposed remote from the portions of the core on which the windings are mounted, this ignition coil does not solve the problem resulted from the leakage of magnetic flux.

SUMMARY OF THE INVENTION

It is, therefore, an object of the present invention to provide an ignition coil for an internal combustion engine to reduce the leakage of magnetic flux and increase the output voltage without causing the ignition coil to become large.

In accomplishing the above and other objects, an ignition coil for an internal combustion engine comprises a center core having a plurality of core members aligned, and at least one permanent magnet which is disposed between the core members. A primary winding and a secondary winding are mounted on the center core and permanent magnet, and at least the primary winding is arranged to substantially enclose therein the permanent magnet. An outer core having at least one core member is disposed around the primary winding and secondary winding. One end of the outer core is connected to one end of the center core, whereas the other end of the outer core is connected to the other end of the center core.

In the above-described ignition coil, at least one permanent magnet is preferably disposed substantially in the center of one of the sections into which the primary winding is divided equally in a longitudinal direction thereof by the number of at least one permanent magnet.

In the above-described ignition coil, the outer core preferably comprises two core members which are formed in a C-shape respectively and disposed around the primary winding and secondary winding.

BRIEF DESCRIPTION OF THE DRAWINGS

The above stated objects and following description will become readily apparent with reference to the accompanying drawings, wherein like reference numerals denote like elements, and in which.

DESCRIPTION OF THE PREFERRED EMBODIMENTS

Figure 1:
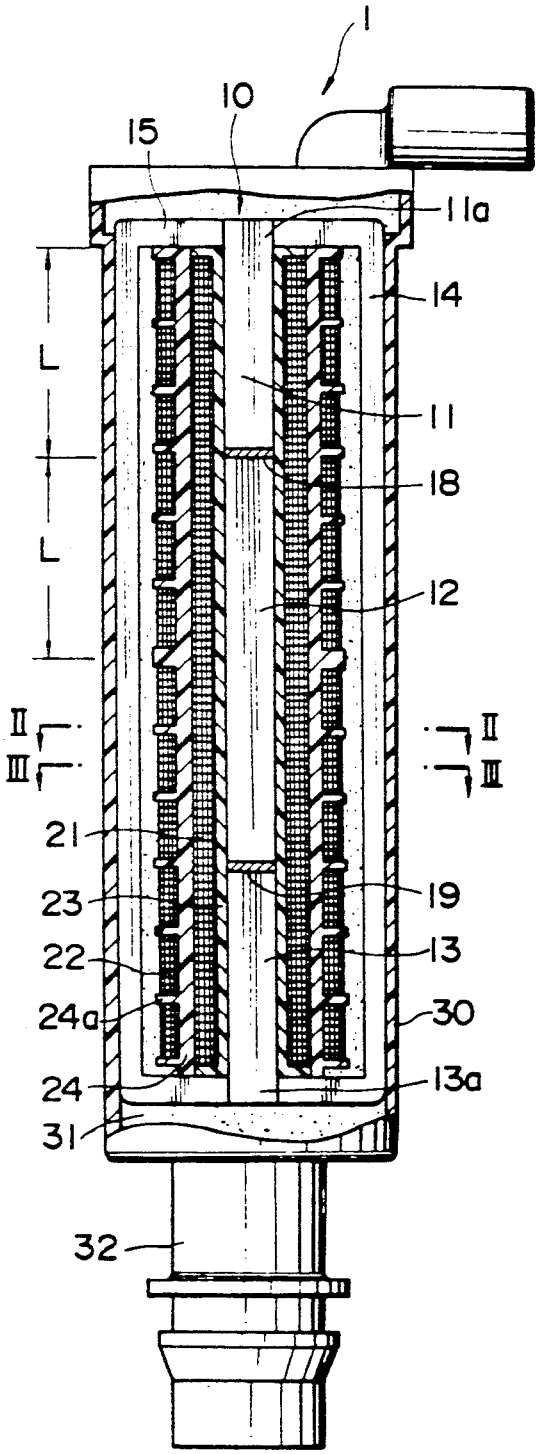
FIG. 1 is a sectional view of an embodiment of an ignition coil according to the present invention.
Figure 2:
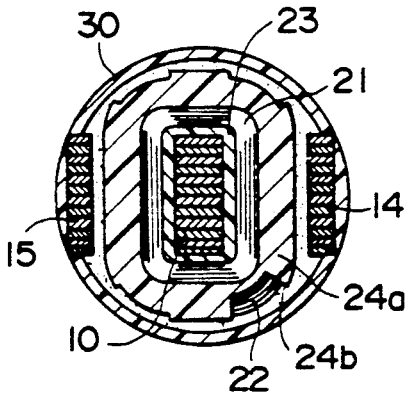
FIG. 2 is a sectional view taken along the line II—II in FIG. 1.
Figure 3:
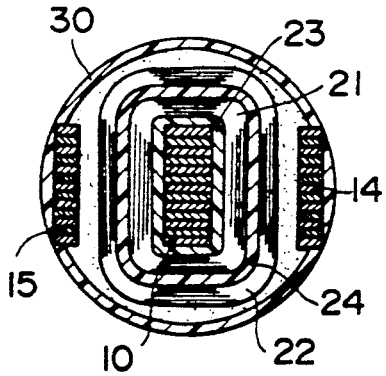
FIG. 3 is a sectional view taken along the line III—III in FIG. 1.

Refering to FIGS. 1 to 3, there is illustrated an embodiment of the ignition coil according to the present invention. An ignition coil 1 has substantially closed magnetic circuits formed by a center core 10 and a pair of permanent magnets 18, 19, on which a primary winding 21 and a secondary winding 22 are mounted, and a pair of core members 14, 15 which are connected to the center core 10 for surrounding the windings 21, 22 and constituting an outer core. The primary winding 21 is wound on a primary bobbin 23, while the secondary winding 22 is wound on a secondary bobbin 24. The primary and secondary bobbins 23, 24 are made of synthetic resin and formed in a spool having a small bore defined therein and a spool having a large bore defined therein respectively. With the primary and secondary windings 21, 22 mounted on the primary and secondary bobbins 23, 24 respectively, the primary bobbin 23 is received within the bore defined in the secondary bobbin 24. The secondary bobbin 24 is formed of a plurality of peripheral walls 24*a* which divides the outer surface of the bobbin 24 into a plurality of groove sections. A large number of turns of wire for the secondary winding 22 is wound on the groove sections of the secondary bobbin 24 in series through cutout portions 24*b* as shown in FIG. 2.

The center core 10 of the present embodiment includes three core members 11, 12 and 13 between which the permanent magnets 18, 19 are inserted. The permanent magnets 18, 19 are disposed so as to be positioned substantially in the center of each section of the sections into which the inside of the primary winding 21 is divided equally in a longitudinal direction by the number of the permanent magnets to be disposed, i.e., two sections according to the present embodiment. As illustrated in FIG. 1, each of the permanent magnets 18, 19 is disposed at one end side position and the other end side position out of three positions dividing the inside of the primary winding 21 into four sub-sections having a length of (L) each. The core members 11, 12, 13 having a rectangular cross-section each are disposed next to the permanent magnets 18, 19. Accordingly, the core member 12 has a length of ($2\times L$) as shown in FIG. 1, whereas other core members 11, 13 have a length of (L) in FIG. 1 each, and are disposed such that each one end of them extends outward of the primary winding 21. The permanent magnets 18, 19 are disposed such that they provide the magnetic flux in the same direction, and that the direction of their magnetic flux is opposite to the direction of the magnetic flux produced in the core members 11, 12, 13 when the electric current is fed to the primary winding 21. The permanent magnets 18 and 19 have the same thickness, which is a half of the thickness of a single permanent magnet disposed in lieu of two magnets.

The primary bobbin 23 is made by insert-molding in such a manner that the core member 11, permanent magnet 18, core member 12, permanent magnet 19 and core member 13 are placed concentrically in a die for plastic molding (not shown) and molded by synthetic resin. With the extended end portions 11*a*, 13*a* held, the primary winding 21 is mounted on the primary bobbin 23. Then, these are inserted into the bore of the secondary bobbin 24 on which the secondary winding 22 has been mounted, and the core members 14, 15 are disposed surrounding the secondary winding 22 and connected to the core members 11, 13. The core members 14, 15 are formed in a C-shape respectively, and their respective open ends are fixed to the side surfaces of the extended end portions 11*a*, 13*a* to be magnetically connected therebetween. Accordingly, the core members 11 to 15 and the permanent magnets 18, 19 form a pair of substantially closed magnetic circuits.

The core members 11 to 15 are constituted, for example, by grain oriented silicon steel plates stacked one on the other. As well known, the grain oriented silicon steel plate has a good magnetic characteristic in its rolled direction, while the magnetic flux passing therethrough is decreased in a direction other than the rolled direction. For example, in the case where the magnetic flux of 1.7 tesla(T) is allowed to pass through the plate in its rolled direction, the magnetic flux of 1.1 (T) will be allowed at most to pass through the plate in the direction of 45 degree to the rolled direction, which direction is most severe in terms of the magnetic characteristic. Therefore, the width(Wa) of a portion of each of the core members 14, 15 perpendicular to the longitudinal axis thereof and the width(Wb) of the longitudinal portion of the core members 14, 15 are determined in accordance with the equation of ($Wa \approx Wb \times 1.7/1.1$). The core members 11, 13 may be formed integrally with the core members 14, 15.

The core members 11 to 15, the primary winding 21 mounted on the primary bobbin 21 and the secondary winding 22 mounted on the secondary bobbin 24 are disposed within a case 30 made of synthetic resin. The primary winding 21 has one end connected to a battery (not shown) and the other end connected to a control circuit, i.e., so-called igniter (not shown). The secondary winding 22 has one end connected to the battery together with the one end of the primary winding 21, and the other end connected to an electrode (not shown) in a secondary connector 32 which is molded integrally with the case 30 to be electrically connected to an ignition plug (not shown) or a distributor (not shown). The electrode of the secondary connector 32 is directly connected to the ignition plug according to a well-known coil distribution ignition system, in which an ignition coil is disposed for each ignition plug instead of the conventional distributor. Then, a thermosetting synthetic resin is filled in the case 30 and set to form a resin portion 31. Thus, the primary and secondary windings 21, 22 are impregnated and made rigid with such resin, and the insulation is ensured to endure the high output voltage obtained from the secondary winding 22.

In operation, when the primary current is intermittently applied with a predetermined frequency to the primary winding 21 of the ignition coil 1 as structured in the above through a control circuit (not shown), the magnetic flux variation is produced in the closed magnetic circuit of the core members 11 to 15 and the permanent magnets 18, 19. Consequently, a predetermined high voltage is obtained from the secondary winding 22 to be supplied through the secondary connector 32 to the ignition plug directly, or through the distributor. In this operation, a large effective magnetic flux variation is produced by the presence of the permanent magnets 18, 19 disposed between the core members 11, 12 and 13.

Figure 4E:
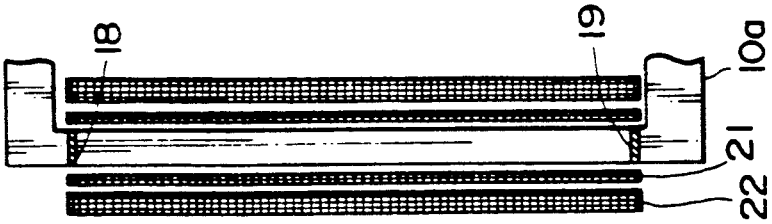
FIGS. 4A, 4B, 4C, 4D and 4E are schematic illustrations of the front views of ignition coils having two permanent magnets disposed in a primary winding.
Figure 4D:
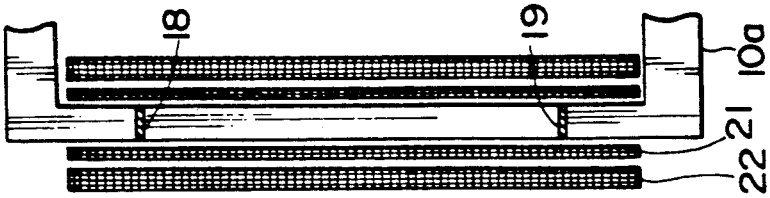
Figure 4C:
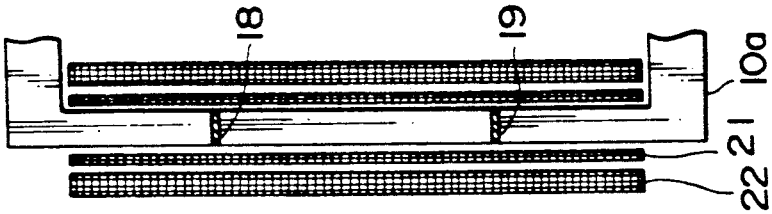
Figure 4B:
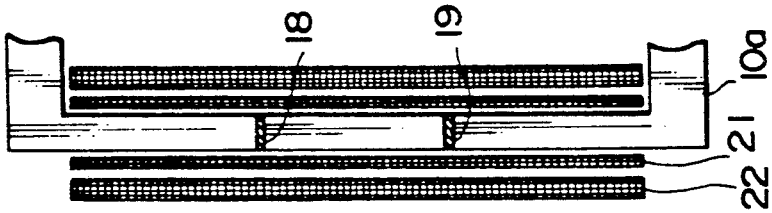
Figure 4A:
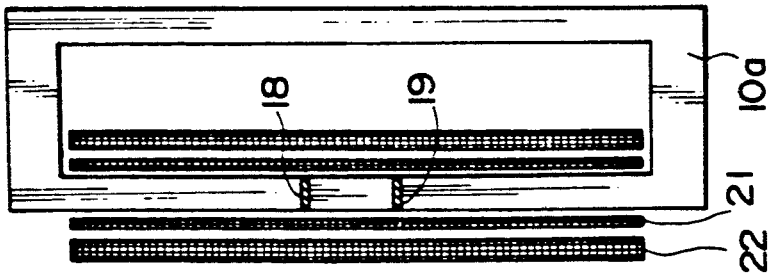
Figure 5:
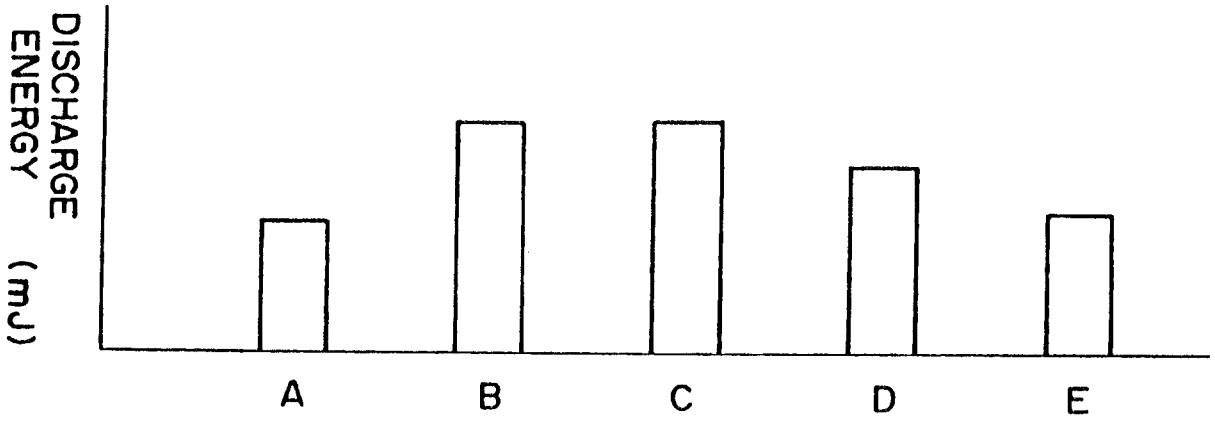
FIG. 5 is a diagram showing discharge energy obtained in each ignition coil shown in FIGS. 4A to 4E.

In the present embodiment, the permanent magnets 18, 19 are disposed substantially in the center of one of the two sections into which the inside of the primary winding 21 is divided equally in a longitudinal direction, as schematically illustrated in FIG. 4C. Therefore, the leakage of magnetic flux in the present embodiment is small, in comparison with the comparing embodiments in which the permanent magnets 18, 19 are disposed in the central portion, close to each other as shown in FIG. 4A, or they are disposed near both ends of the primary winding 21, i.e., remote from each other as shown in FIGS. 4D and 4E. Consequently, the magnetic flux produced in a core 10*a* in response to the primary current intermittently fed will be increased to obtain the maximum discharge energy as indicated by "C" in FIG. 5. At the same time, the magnetic flux variation will be increased, so that the output voltage obtained from the secondary winding 22 in the present embodiment will be increased. The core 10*a* shown in FIGS. 4A to 4E represents the core members 11 to 15. Each of "A" to "E" in FIG. 5, where the ordinate denotes the discharge energy (mJ), indicates the output characteristic corresponding to each of the ignition coils illustrated in FIGS. 4A to 4E. In the case where a plurality of permanent magnets are disposed as in the present embodiment, the permanent magnets may be disposed at the positions which divides the inside of the primary winding 21 equally into the same number of sections as that adding to the number of the permanent magnets by one, e.g., three sections divided equally as shown in FIG. 4B. Then, the discharge energy, which is almost equal to that obtained in the present embodiment shown in FIG. 4C and indicated by "C" in FIG. 5, will be obtained as indicated by "B" in FIG. 5.

Figure 6A:
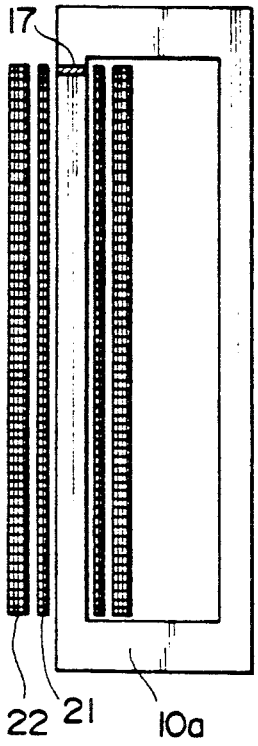
FIGS. 6A, 6B and 6C are schematic illustrations of the front views of ignition coils having a single permanent magnet disposed in a primary winding.
Figure 6B:
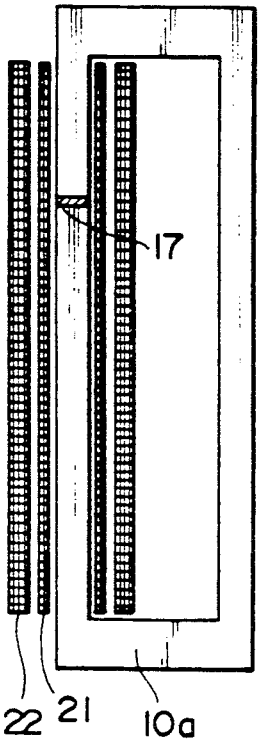
Figure 6C:
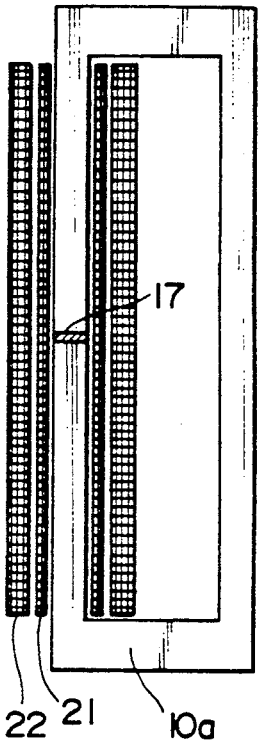
Figure 7:
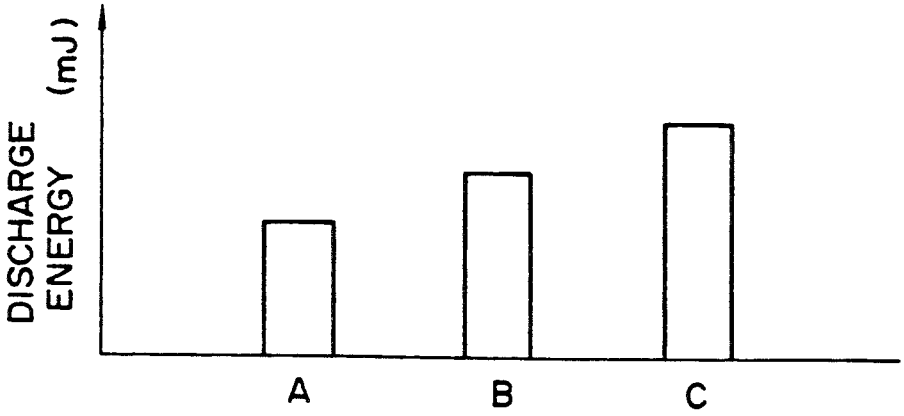
FIG. 7 is a diagram showing discharge energy obtained in each ignition coil shown in FIGS. 6A, 6B and 6C.
Figure 9:
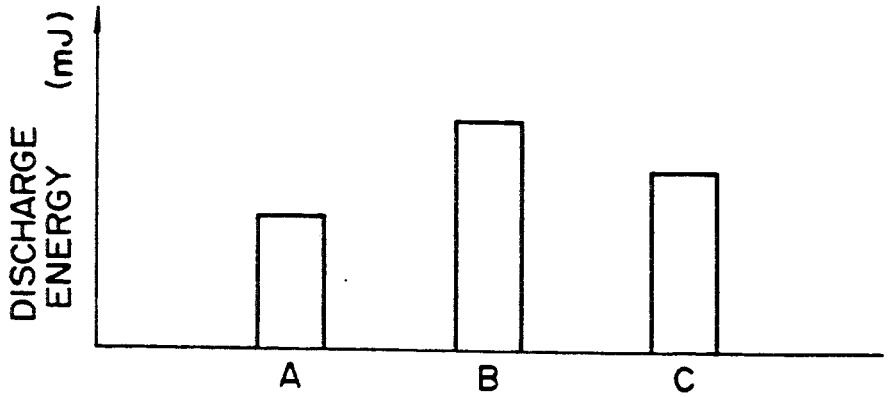
FIG. 9 is a diagram showing discharge energy obtained in each ignition coil shown in FIGS. 8A, 8B and 8C.

In the case where one or three permanent magnets are disposed, while two permanent magnets are disposed in the above embodiment, the output characteristics of the secondary winding 22 in accordance with the position of the magnets in the primary winding 21 will be those as shown in FIGS. 7 and 9. As for an ignition coil having a single permanent magnet 17, the discharge energy will be maximum when the magnet 17 is disposed in the longitudinal center of the inside of the primary winding 21 as shown in FIG. 6C. Comparing with the discharge energy (indicated by "A" in FIG. 7) obtained in the ignition coil having the magnet 17 disposed in an end portion of the primary winding 21 as shown in FIG. 6A, or the discharge energy (indicated by "B" in FIG. 7) obtained in the ignition coil having the magnet 17 disposed in such a position that is close to an end of the inside of the primary winding 21 out of the positions for dividing the same equally in a longitudinal direction into four sections as shown in FIG. 6B, it will be realized that the discharge energy (indicated by "C" in FIG. 7) in the ignition coil as shown in FIG. 6C is the largest.

Figure 8A:
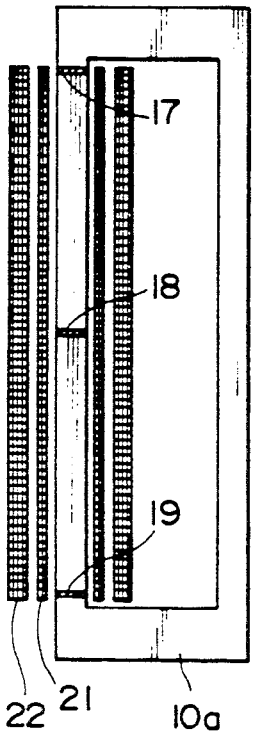
FIGS. 8A, 8B and 8C are schematic illustrations of the front views of ignition coils having three permanent magnets disposed in a primary winding.
Figure 8B:
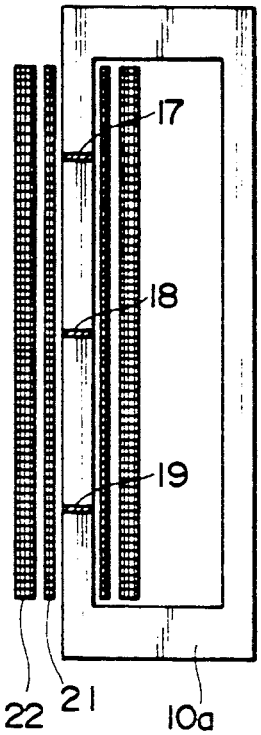
Figure 8C:
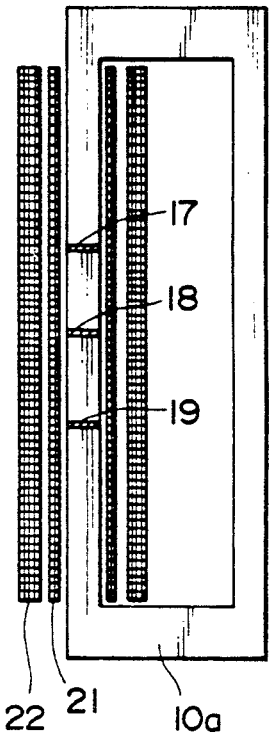

In the case where three permanent magnets 17, 18 and 19 are disposed in the primary winding 21 as shown in FIGS. 8A, 8B and 8C, their output characteristics will be those as shown in FIG. 9. Comparing with the discharge energy (indicated by "A" in FIG. 9) obtained in the ignition coil having the magnets 17, 18, 19 disposed in the longitudinal center of the inside of the primary winding 21 and at both ends thereof as shown in FIG. 8A, or the discharge energy (indicated by "C" in FIG. 9) obtained in the ignition coil having the magnets 17, 18, 19 disposed in the central portion of the inside of the primary winding 21 as shown in FIG. 8C, it will be realized that the discharge energy obtained in the ignition coil having the magnets disposed in each center of three sections into which the inside of the primary winding is divided as shown in FIG. 8B will be maximum as indicated by "B" in FIG. 9. In this case, the thickness of each magnets 17, 18, 19 is made to be one third of that of the single magnet 17 shown in FIG. 6C.

Figure 10:
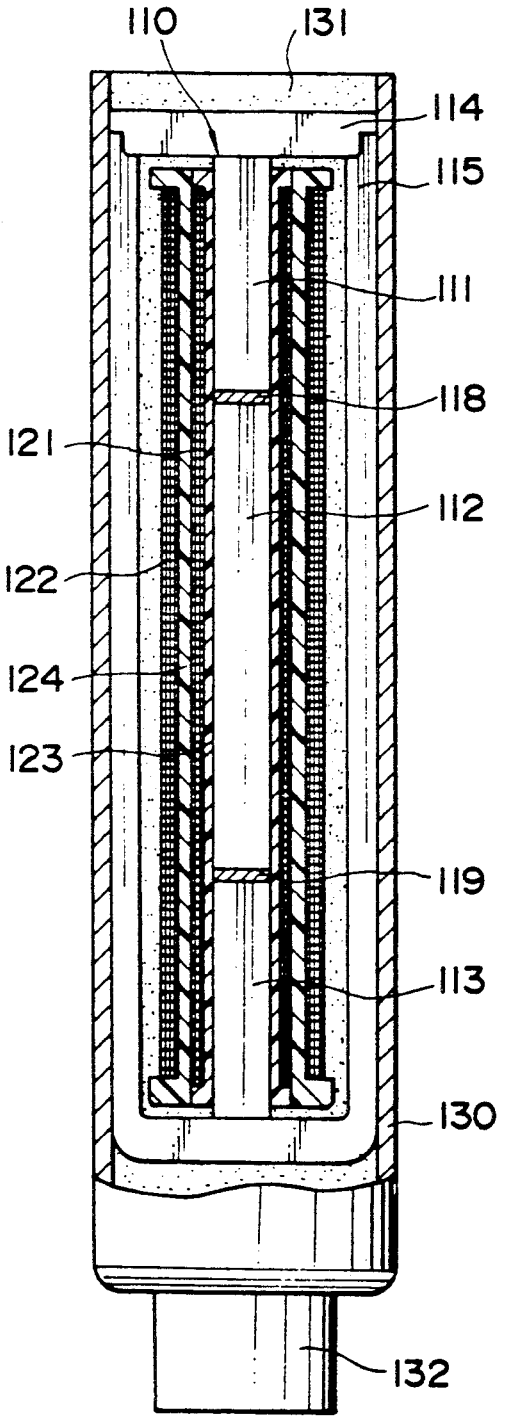
FIG. 10 is a sectional view of another embodiment of an ignition coil according to the present invention.

FIG. 10 shows another embodiment according to the present invention. In this embodiment, a primary winding 121 and a secondary winding 122 are mounted respectively on a primary bobbin 123 and a secondary bobbin 124 which receives the primary bobbin 123 in its bore. A center core 110 is disposed in the bore of the primary bobbin 123 with permanent magnets 118, 119. The center core 110 includes three core members 111, 112 and 113, and the permanent magnets 118 and 119 are inserted therebetween in such a manner that the directions of magnetic flux are opposite to the direction of magnetic flux produced by the primary winding 121. The permanent magnets 118, 119 have the thickness of a half of the thickness of the single permanent magnet disposed in lieu of those. Core members 114, 115 constituting an outer core are connected to the end faces of the core members 111 and 113 to form substantially closed magnetic circuits. The core member 114 is formed in an I-shape, and the core member 115 is formed in a U-shape. Each end of the core member 115 is connected to each end of the core member 114. The core members 114, 115 have stepped-portions formed on their both ends, so that the core member 114 is press-fitted into the core member 115 to connect magnetically each other. The core members 111 to 115 are constituted by silicon steel plates stacked one on the other. The thermosetting synthetic resin is filled in a case 130, which has a secondary connector 132 integrally formed therewith and which receives the above-described components, and set to form a resin portion 131. The remaining structure is similar to that of the embodiment shown in FIG. 1, so that the description thereof will be omitted.

Figure 11A:
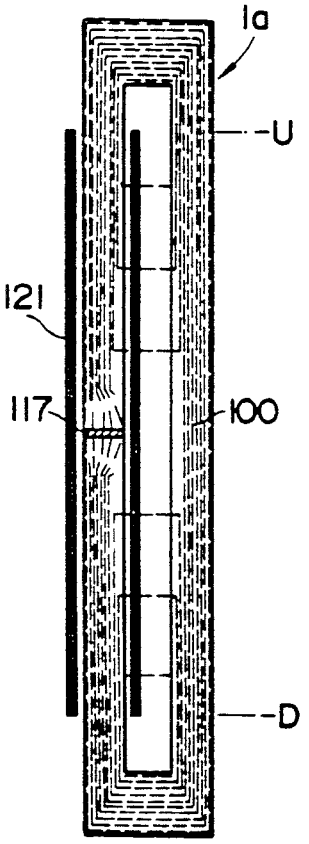
FIG. 11A is a front view showing the distribution of magnetic flux in an ignition coil having a single permanent magnet disposed in a primary winding.
Figure 11B:
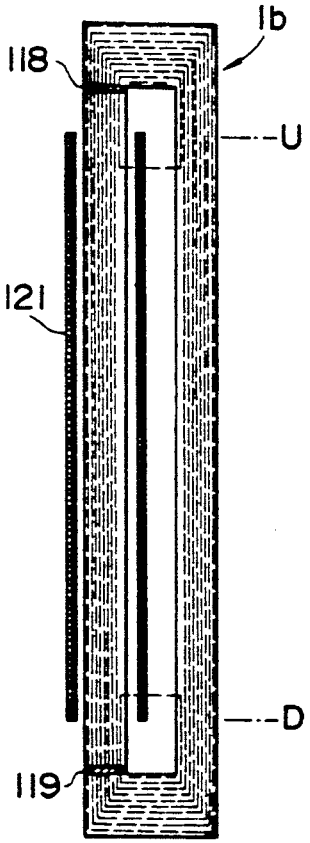
FIG. 11B is a front view showing the distribution of magnetic flux in an ignition coil having a pair of permanent magnets disposed outside of a primary winding.
Figure 11C:
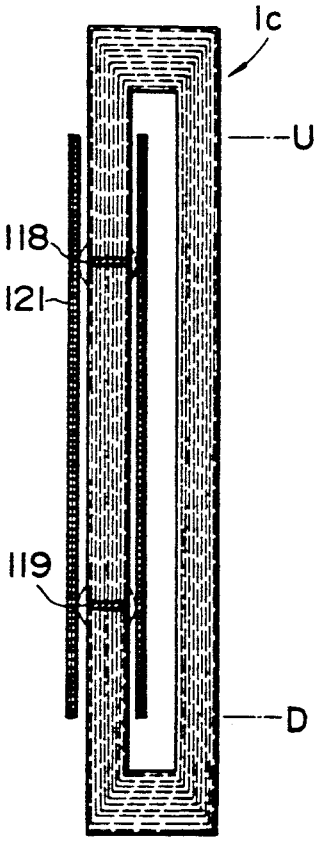
FIG. 11C is a front view showing the distribution of magnetic flux in an ignition coil having a pair of permanent magnets disposed in a primary winding.

FIGS. 11A, 11B and 11C illustrate the relationship between the leakage of magnetic flux and the number of permanent magnets or the positions thereof in the primary winding of the ignition coil. In FIGS. 11A, 11B and 11C, the structure of the ignition coil is schematically illustrated, with the secondary winding, case and others omitted for simplicity. FIG. 11A illustrates an ignition coil 1*a* in which a single permanent magnet 117 is disposed in a gap of a core 100 representing the center core and outer core, and positioned in the center of the primary winding 121. In this ignition coil 1*a*, the leakage of magnetic flux is reduced in the center portion of the primary winding 121, since the portion of the core 100 having the permanent magnet 117 is received in the primary winding 121. FIG. 11B illustrates an ignition coil 1*b* in which two permanent magnets 118, 119 are disposed outside of the primary winding 121 but in the vicinity of its both ends. In this ignition coil 1*b*, the leakage of magnetic flux is reduced more than that in the ignition coil 1*a* as shown in FIG. 11A. FIG. 11C illustrates an ignition coil 1*c* which corresponds to the embodiment shown in FIG. 10, and in which the leakage of magnetic flux is minimized.

Figure 12:
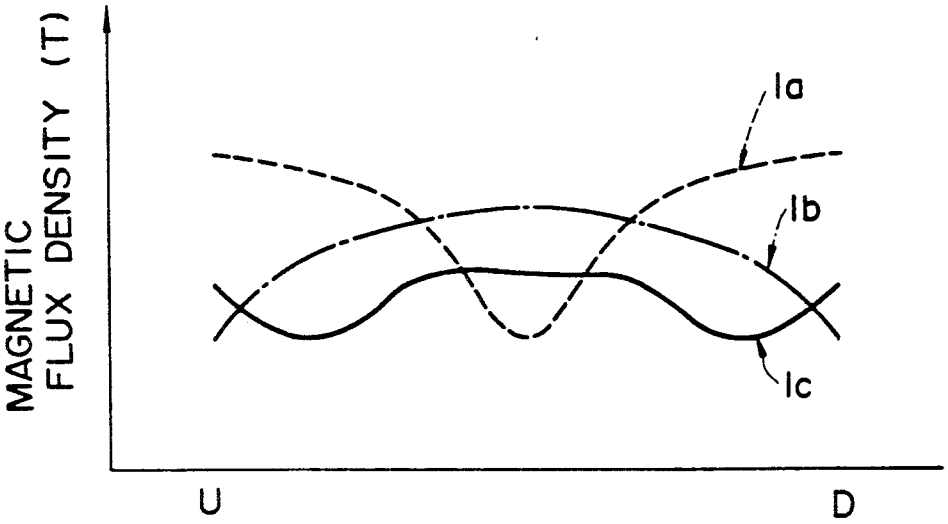
FIG. 12 is a diagram showing the magnetic flux density of ignition coils shown in FIGS. 11A, 11B and 11C.
Figure 13:
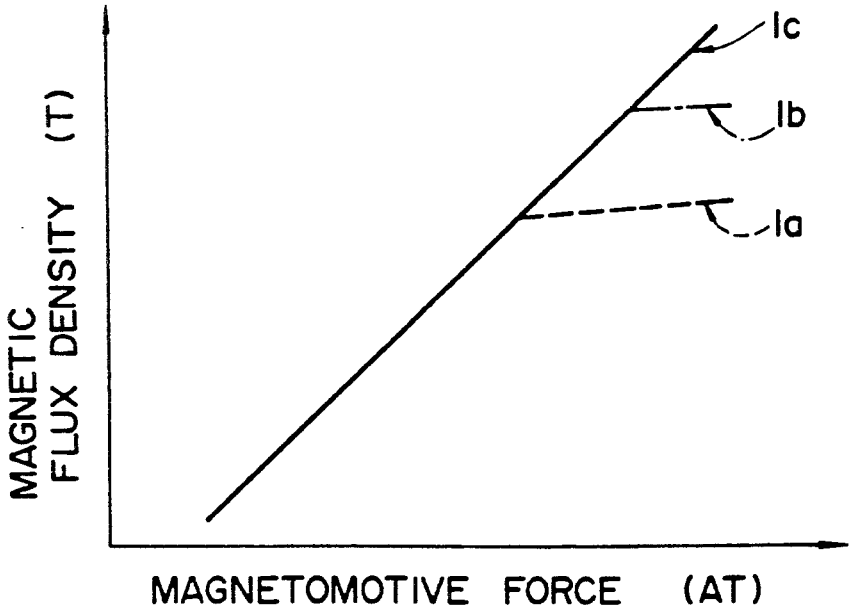
FIG. 13 is a diagram showing the relationship between the magnetic flux density and the magnetomotive force in ignition coils shown in FIGS. 11A, 11B and 11C.
Figure 14:
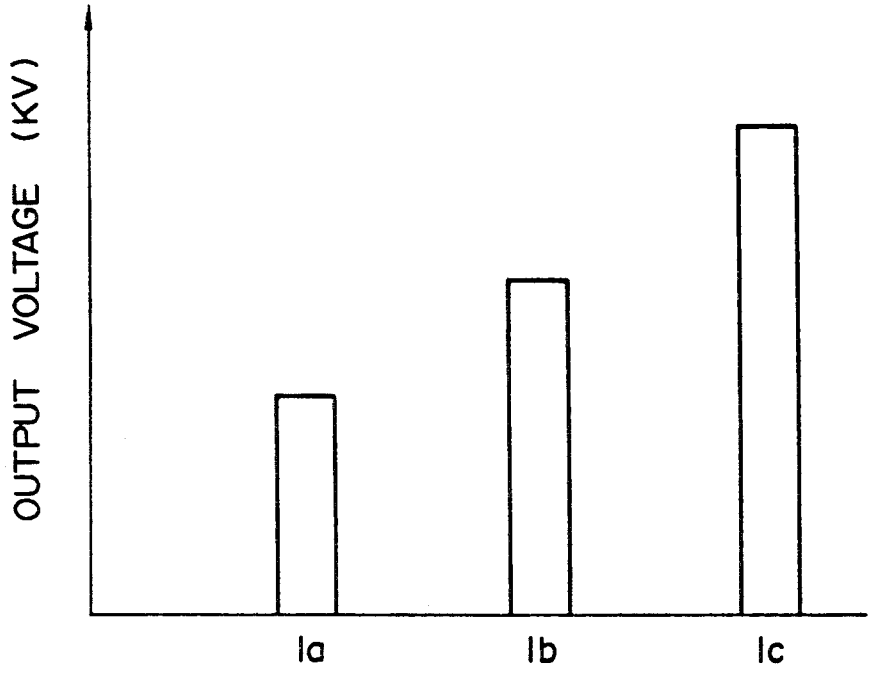
FIG. 14 is a diagram showing the output voltage in each of the ignition coils shown in FIGS. 11A, 11B and 11C.
Figure 15:
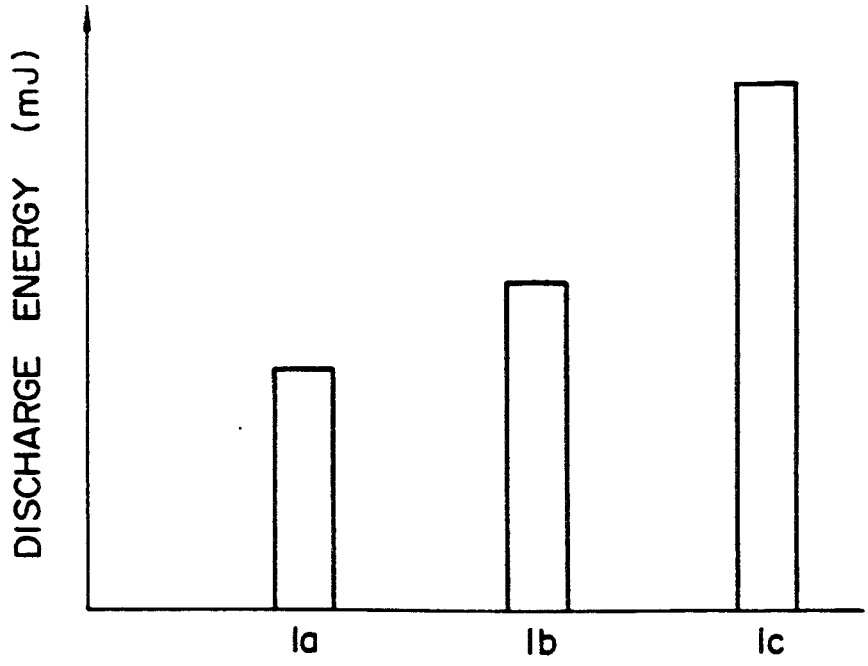
FIG. 15 is a diagram showing the discharge energy in each of the ignition coils shown in FIGS. 11A, 11B and 11C.

FIG. 12 shows the distribution of magnetic flux density from an upper portion (U) to a lower portion (D) of each of the ignition coils 1*a*, 1*b* and 1*c* shown in FIGS. 11A, 11B and 11C. In FIG. 12, it is found that the difference in magnetic flux density between the portions (U, D) and the permanent magnet portion in the ignition coil 1*b* is smaller than that in the ignition coil 1*a*, and the difference in magnetic flux density between the portions (U, D) and the permanent magnet portion in the ignition coil 1*c* is smaller than that in the ignition coil 1*b*. Thus, if the ignition coil is structured like the ignition coil 1*c*, the cross sectional area of the core portion may be made smaller, provided that the predetermined magnetic flux is ensured throughout the whole closed magnetic circuit. FIG. 13 shows a magnetic flux density variation produced in response to the magnetomotive force of the primary winding 21 of each ignition coil. In FIG. 13, it will be realized that the magnetic flux density obtained in the ignition coil 1*b* is higher than that in the ignition coil 1*a*, and the magnetic flux density obtained in the ignition coil 1*c* is higher than that in the ignition coil 1*b*. Consequently, both the output voltage and the discharge energy of each ignition coil are higher in order of the ignition coils 1*a*, 1*b*, 1*c* as shown in FIGS. 14 and 15.

It should be apparent to one skilled in the art that the above-described embodiment is merely illustrative of but a few of the many possible specific embodiments of the present invention. Numerous and various other arrangements can be readily devised by those skilled in the art without departing from the spirit and scope of the invention as defined in the following claims.

What is claimed is:

1. An ignition coil for an internal combustion engine comprising:

a center core having a plurality of core members aligned along an axis thereof;

a plurality of permanent magnets disposed between said plurality of core members;

a primary winding and a secondary winding mounted on said center core and said plurality of permanent magnets, at least said primary winding substantially enclosing therein said plurality of permanent magnets, said plurality of permanent magnets longitudinally dividing said primary winding into a plurality of equal sections, wherein each one of said plurality of magnets is disposed substantially in the center of each one of said plurality of equal sections; and an outer core having at least one core member disposed around said primary winding and said secondary winding, one end of said outer core being connected to one end of said center core, and the other end of said outer core being connected to the other end of said center core.

2. An ignition coil for an internal combustion engine as set forth in claim 1, wherein said outer core comprises two core members formed in a C-shape respectively and disposed around said primary winding and said secondary winding.

3. An ignition coil for an internal combustion engine as set forth in claim 1, including a primary bobbin for mounting thereon said primary winding and receiving therein said center core and said permanent magnet, and a secondary bobbin for mounting thereon said secondary winding and receiving therein said primary bobbin with said primary winding mounted thereon.

4. An ignition coil for an internal combustion engine as set forth in claim 3, wherein said outer core comprises two core members formed in a C-shape respectively and disposed around said secondary bobbin with said secondary winding mounted thereon.

5. An ignition coil for an internal combustion engine as set forth in claim 4, wherein said center core includes two core members having each one end thereof extending out of said primary bobbin and wherein both ends of said core members formed in a C-shape respectively are connected to said extending ends of said core members of said center core.

6. An ignition coil for an internal combustion engine as set forth in claim 3, wherein said outer core comprises a first core member formed in an I-shape and a second core member formed in a U-shape whose ends are connected to both ends of said first core member, and wherein said first core member is connected to one end of said center core and said second core member is connected to the other end of said center core.

7. An ignition coil for an internal combustion engine as set forth in claim 1, wherein at least a part of said center core is formed integrally with said outer core.

* * * * *